US006068518A

United States Patent [19]

McEuen

[11] Patent Number: 6,068,518

[45] Date of Patent: May 30, 2000

[54] CIRCUIT BOARD CONNECTOR PROVIDING INCREASED PIN COUNT

[75] Inventor: Shawn McEuen, Hillsboro, Oreg.

[73] Assignee: Intel Corporation, Santa Clara, Calif.

[21] Appl. No.: 09/128,451

[22] Filed: Aug. 3, 1998

[51] Int. Cl.[7] ..... H01R 33/00

[52] U.S. Cl. ..... 439/660; 439/79; 439/284

[58] Field of Search ..... 439/61, 74, 79, 439/80, 660, 62, 284, 291

[56] References Cited

U.S. PATENT DOCUMENTS

| | | | |
|---|---|---|---|
| 3,553,633 | 1/1971 | Ondrejka | 439/339 |
| 4,585,285 | 4/1986 | Martens | 439/62 |
| 4,971,565 | 11/1990 | Fox, Jr. | 439/74 |
| 5,071,363 | 12/1991 | Reylek et al. | 439/291 |
| 5,110,298 | 5/1992 | Dorinski et al. | 439/65 |
| 5,156,553 | 10/1992 | Katsumata et al. | 439/62 |
| 5,181,855 | 1/1993 | Mosquera et al. | 439/74 |

*Primary Examiner*—Renee S. Luebke
*Assistant Examiner*—T. C. Patel
*Attorney, Agent, or Firm*—Blakely, Sokoloff, Taylor & Zafman LLP

[57] ABSTRACT

A connector includes a first connector housing having a primary surface formed with a plurality of channels, with a first set of contacts arranged three-dimensionally along the primary surface for electrical connection to a circuit board such as a module or a daughtercard. Attached to the main board of the computer system is a second connector housing, also having a primary surface. A corresponding set of second contacts is disposed along the primary surface of the second connector housing, with the primary surface of the second connector housing being formed with a corresponding plurality of fingers mated to the channels. The second set of contacts is arranged on the fingers such that when the first and second connector housings are placed in a mated relationship by inserting the fingers into the channels, the first and second sets of contacts are individually aligned with one another, and mating of the first and second connector housings establishes electrical connection between corresponding ones of the first and second sets of contacts.

30 Claims, 4 Drawing Sheets

CIRCUIT BOARD CONNECTOR PROVIDING INCREASED PIN COUNT

FIELD OF THE INVENTION

The present invention relates generally to the field of circuit board connectors; more particularly, to low profile connectors utilized in modular computer systems.

BACKGROUND OF THE INVENTION

It is not surprising that the newer, higher performance microprocessors, which provide larger data handling capabilities at higher speeds, require an increased number of electrical connections. Simply put, the clear trend in the computer industry is towards integrated circuits and chipsets having a larger number of interconnections. At the system level, this trend has placed demands on the connector technology that provides electrical interconnections between various circuit boards comprising a computer system.

For example, in the mobile computing market there is a demand for low profile connectors that provide a large number of interconnections (i.e., pins) for circuit boards connected to the main system board (i.e., motherboard) of the computer. These additional circuit boards or cards, which are attached to the system board, are frequently referred to as daughtercards. Presently, conventional stacked connectors provide a linear row of pins, which may provide up to 280 connection points for a typical circuit board connected to a computer motherboard. Although the traditional stacked connector approach has proven adequate in the past, there is still a need for more advanced connectors which provide even larger pin counts without increasing the profile height or thickness of the mated boards.

As will be seen, the present invention provides a board-to-board connector that allows a card or module to be mounted either co-planar with a computer system main board, or stacked onto the main board, depending upon the main board configuration. The invention provides a three-dimensional connection surface area that yields a substantially increased pin count.

SUMMARY OF THE INVENTION

With the advent of mobile computing, it is now increasingly important to provide downsized computer platforms wherein major components, such as main circuit boards or motherboards can be upgraded or enhanced by connecting sophisticated computer modules or daughtercards. It is accordingly desirable to provide a board-to-board connector that provides easy connection in a variety of orientations while maximizing the number of electrical connections in a minimal form factor. Ideally, such a connector could be advantageously employed in portable-computer applications.

In one particular embodiment, the connector of the present invention includes a first connector housing having a primary surface formed with a plurality of channels. A first set of contacts is disposed along the primary surface for electrical connection to a circuit board such as a module or a daughtercard. The first set of contacts is generally disposed within the channels in a three dimensional arrangement.

Attached to the main board of the computer system is a second connector housing, also having a primary surface. A corresponding set of second contacts is disposed along the primary surface of the second connector housing. Appropriately, the primary surface of the second connector housing is formed with a corresponding plurality of fingers mated to the channels. The second set of contacts is arranged on the fingers such that the first and second connector housings are placed in a mated relationship by inserting the fingers into the channels. As the first and second sets of contacts are individually aligned with one another, mating of the first and second connector housings establishes electrical connection between corresponding ones of the first and second sets of contacts.

By attaching the second connector housing to either protrude vertically or horizontally with respect to a primary planar surface of the main circuit board, either a stacked or a coplanar orientation of the two boards can be achieved.

BRIEF DESCRIPTION OF THE DRAWINGS

The present invention is illustrated by way of example, and not by way of limitation, in the figures of the accompanying drawings, where.

DETAILED DESCRIPTION

Throughout the following description specific details are set forth in order to provide a more thorough understanding of the invention. However, the invention may be practiced without these particulars. In other instances, well known elements have not been shown or described in detail to avoid unnecessarily obscuring the present invention. Accordingly, the specification and drawings are to be regarded in an illustrative, rather than a restrictive, sense.

Practitioners in the art appreciate that there is an increasing need for computer board connectors that allow small daughtercards, such as expansion cards or circuit modules, to have a single connector design that allows multiple mounting methods. This feature increases the versatility of products by allowing boards to be mounted in a variety of different types of mobile computing platforms.

Figure 1A:
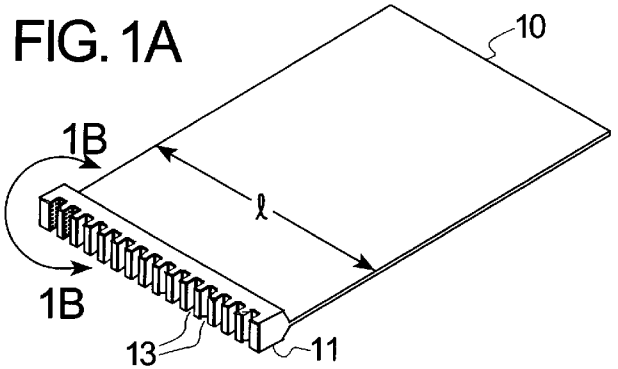
FIG. 1A is a perspective view of a connector for connecting a module or card to another circuit board in accordance with one embodiment of the present invention.

To satisfy this need the present invention provides a board-to-board connector that allows a module or a circuit board to be mounted either coplanar with another board (e.g., a main board) or stacked onto the other board, depending upon the board configuration. FIG. 1A illustrates one embodiment of a connector housing 11 attached along one side of a generally planar circuit board or module 10. Connector housing 11 is co-extensive with the length, l, of the side of circuit board 10.

Figure 1B:
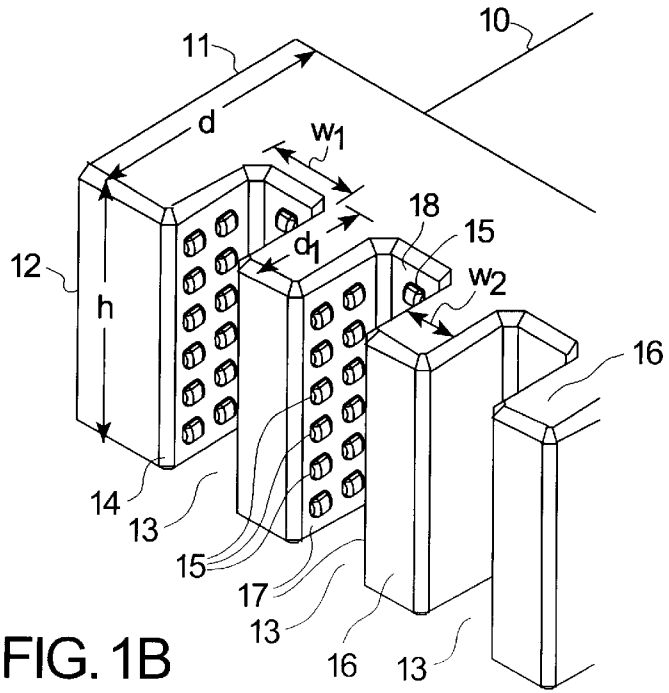
FIG. 1B is an exploded perspective view of a portion of the connector shown in FIG. 1A.

As shown in more detail in the exploded view of FIG. 1B, connector housing 11 includes a primary surface 12 that is formed with a plurality of slots or channels 13, which extend across the length, l, of housing 11. In the illustrated embodiment fifteen grooves or channels 13 are shown, each with three sides: two larger side surfaces 17 and one smaller end surface 18. A peninsula or finger section 16 having a width, $w_2$, separates each of the channels 13. FIG. 1B also illustrates two columns of connector pins arranged along each of sides 17, in a single column of connector pins disposed along side 18.

In the illustrated embodiment, each of the connector pins 15 has a spring-loaded electrical contact head that permits multiple insertion directions. This feature of the present invention will be discussed in more detail later. Contact pins 15 also have multiple rounded edges to facilitate their movement in any direction. Basically, the spring action of pins 15 provides enough pressure against the corresponding contact pads of the reciprocal connector housing to establish electrical connection.

Further note that the primary surface 12 is shown having a bevel 14 along the edges or corners of connector housing 11. Bevel 14, although not essential to the present invention, facilitates physical insertion and mating of pairs of connector housings in various directions.

For the embodiment shown in FIGS. 1A and 1B, thirty contact pins 15 are disposed within each channel 13. However, it should be understood that the number of contact pins 15 disposed within any single channel 13 of connector housing 11 is simply a function of the particular dimensions associated with channels 13 and housing 11. For example, in one embodiment, pins 15 have a contact area of approximately 0.5 mm×0.5 mm on a 1 mm center line pitch. The height, h, of surface 12 is 7 mm; the depth, d, of housing 11 is approximately 6.8 mm; the channel depth, $d_1$, is approximately 2.8 mm; and the channel width, $w_1$, is on the order of 2 mm wide.

For the embodiment shown, anywhere between 360 and 450 contact pins may be provided in a 63.5 mm×4 mm×7 mm form factor. Connector mating is achieved by insertion in either a direct vertical motion, a direct horizontal, or a combination thereof. Of course, other configurations, sizes, dimensions, are possible in accordance with the present invention; each of these being well within the skill of an ordinary practitioner.

Figure 2A:
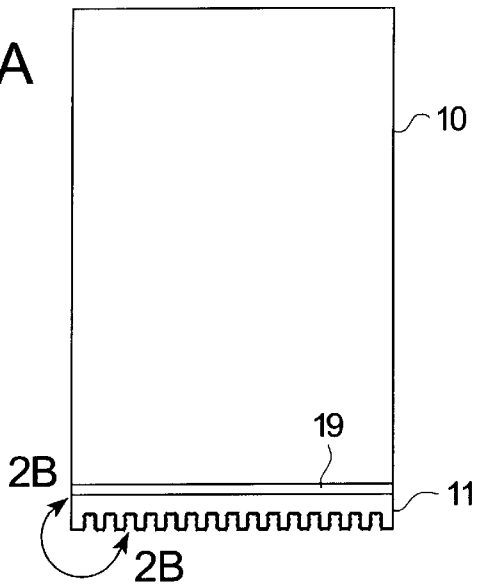
FIG. 2A is a top view of the connector shown in FIG. 1A.
Figure 2B:
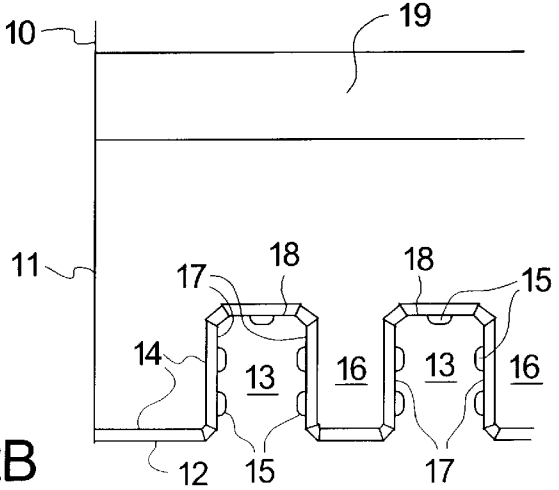
FIG. 2B is an exploded top view of a portion of the connector shown in FIG. 2A.

FIGS. 2A and 2B provide a top view of the circuit board 10 and connector housing 11 shown previously in FIGS. 1A and 1B, respectively. Note that housing 11 includes a back beveled area 19 for attachment to board or module 10. Again, this is an optional consideration in the manufacture of the connector of the present invention.

Figure 3A:
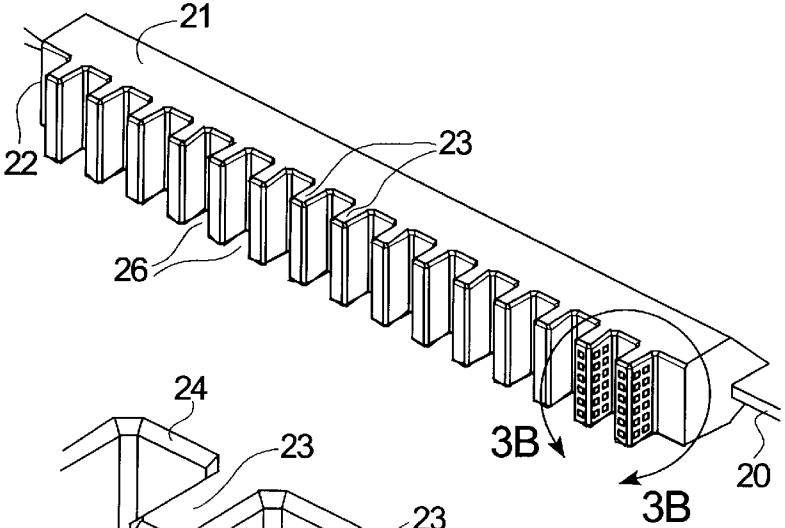
FIG. 3A is a perspective view of a coplanar mating connector utilized in one embodiment of the present invention.
Figure 3B:
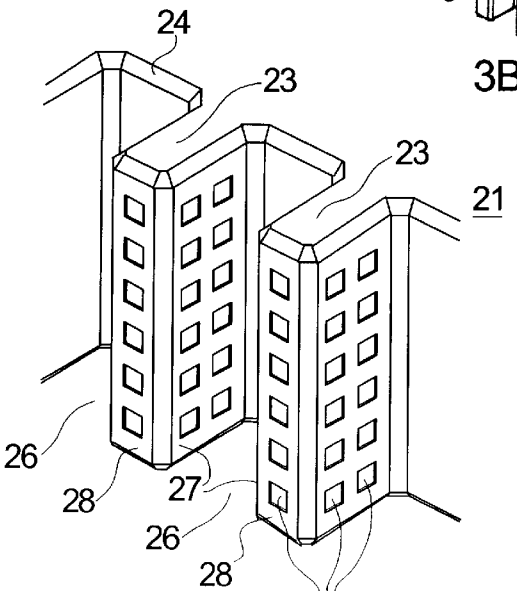
FIG. 3B is an exploded view of a portion of the connector illustrated in FIG. 3A.

FIGS. 3A and 3B show a corresponding mated, connector housing 21 attached to a main circuit board 20. Like connector housing 11, the mating connector housing 21 is formed into a series of fifteen peninsulas or fingers 23, each with three rectilinear sides. It should be appreciated that although the described embodiments illustrate rectilinear shapes, other shapes (e.g., curved or angular) and dimensions may be utilized in accordance with the present invention. Each of the fingers 23 has two side surfaces 27 and an end surface 28. Arranged along surfaces 27 and 28 are a plurality of connector pads 25 which are oriented in corresponding fashion into the contacts 15 of housing 11. This means that the connector pads 25 are located on respective surfaces 27 and 28 such that when the housings 11 and 21 are mated by inserting the fingers 23 into channels 13, individual ones of the connector pins 15 and connector pads 25 are aligned to provide electrical connection between boards 10 and 20.

For instance, each of the side surfaces 27 shown in FIGS. 3A and 3B include two columns of connector pads 25, with one column of connector pads 25 being located on each of the end surfaces 28. Note that in this particular embodiment, the connector pads 25 on the mating connector housing 21 are not spring-loaded. Separating each of the fingers 23 is a slot or opening 26. As before, the primary end surface 22 of housing 21 includes a bevel 24 along the edges or corners to facilitate easy connector insertion from multiple directions. Mated connector housing 21 allows module 10 to be mounted in a coplanar orientation as described further in connection with FIGS. 5A and 5B.

Figure 4B:
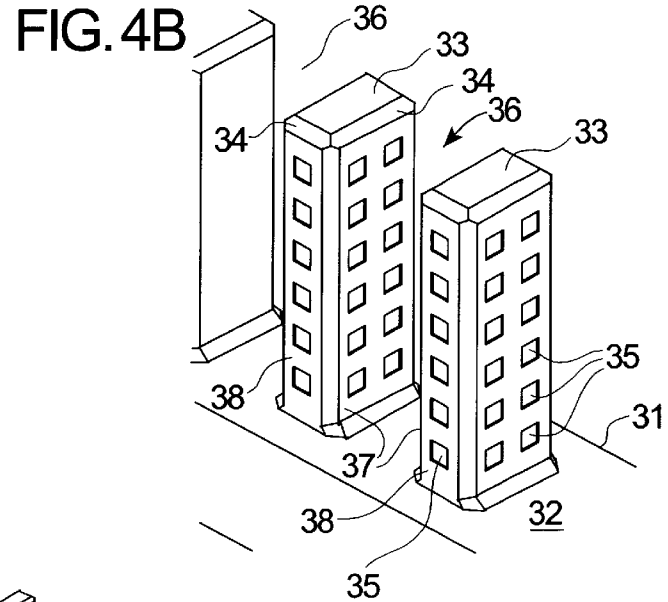
FIG. 4B is an exploded view of a section of the connector shown in FIG. 4A.
Figure 4A:
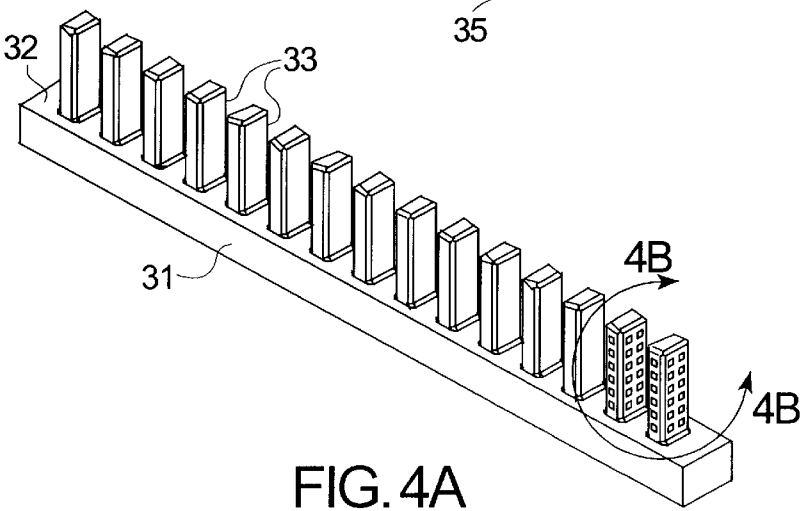
FIG. 4A is a perspective view of a stacked mating connector in accordance with an alternative embodiment of the present invention.

FIGS. 4A and 4B illustrate an alternative embodiment in which a connector housing 31 is attached such that it protrudes vertically from the primary surface of main board 20. As before, connector housing 31 includes a primary surface 32 having a plurality of towers or fingers 33 extending in a vertical direction therefrom. Each of the fingers 33 has two side surfaces 37 and an end surface 38, along which are disposed a plurality of connector pads 35. Connector pads 35 are arranged along surfaces 37 and 38 so as to be oriented in alignment with connector ends 15 of connector housing 11 when the two housings are in a mated relationship. In a mated relationship, fingers 33 fit within corresponding channels 13 of housing 11, with the spaces 36 separating fingers 33 being occupied by sections 16 of housing 11. Each of the fingers 33 is rectilinear in shape and includes a bevel 34 along each of the edges or corners.

Figures 5A, 5B:
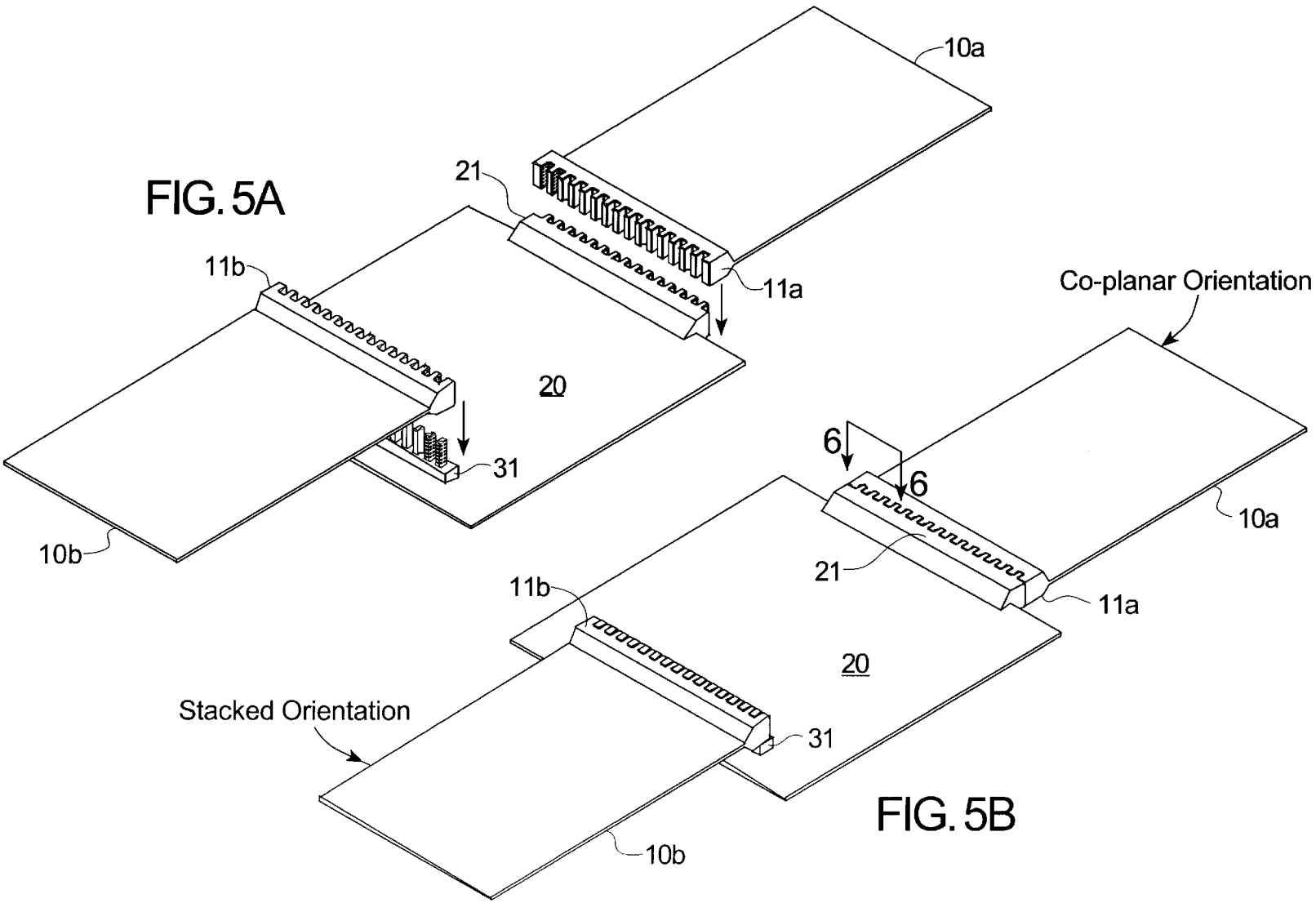
FIG. 5A is the perspective view of mated pairs of connectors, wherein the connectors are positioned prior to mating with the main circuit board.
FIG. 5B illustrates the mated pairs of FIG. 5A after a mating relationship has been established.

The embodiments illustrated in FIGS. 4A and 4B allow the module to be mounted in a stacked orientation to the main board 20. Both the stacked and coplanar orientations are illustrated in FIGS. 5A and 5B. FIGS. 5A and 5B show a pair of circuit boards or modules 10*a* and 10*b* having respective connector housings 11*a* and 11*b* attached to one side of the board. Connector housings 11*a* and 11*b* have elements that are identical to those illustrated in FIGS. 1A and 1B, described above. Main circuit board 20 includes mating connectors 21 and 31 disposed along opposite sides of the circuit board. Connector housing 21 allows module 10*a* to be mounted in a coplanar orientation with respect to main board 20. On the other hand, connector housing 31, which protrudes in a vertical direction with respect to the general planar surface of main board 20, allows module 10*b* to be mounted in a stacked orientation to main board 20.

Practitioners in the art will appreciate the versatility that the present invention provides by allowing modules or boards to be mounted in a wide variety of mobile personal computing applications. Either of the two orientations achieves a connector having a large number of pin/pad configurations within a minimal form factor. For example, when assembled in a coplanar orientation, a minimal 7 mm profile height can be maintained with respect to the system printed circuit board. (Assuming a 4 mm profile height for components mounted on the top surface of the board, a 2 mm profile height for components mounted on the bottom surface and a 1 mm board thickness). The stacked orientation is only slightly thicker, resulting in a 10 mm profile. (Again, assuming the foregoing component and board thickness dimensions).

It is also worth noting that in either the stacked or coplanar orientations, when mated, the pair of connector housings form a solid "block"—with all connections being formed on the interior of the block. The fingers of the mating connector depress the contact pins of the module connector from any angle of engagement, thereby allowing the finger pads to come in contact with the module pins. This latter aspect of the present invention is best seen in the top view of the mated connectors of FIG. 6.

Figure 6:
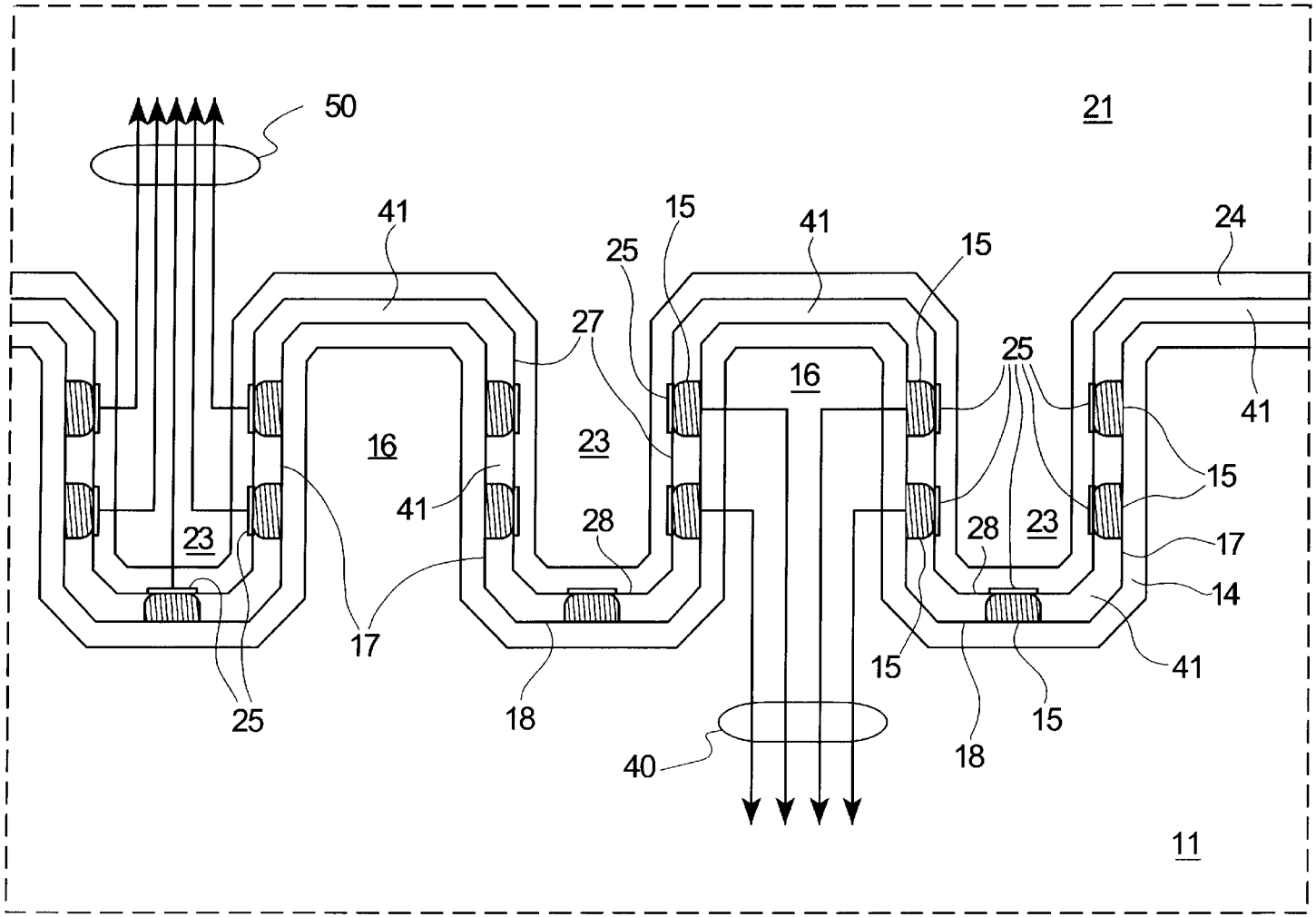
FIG. 6 is a top view of a portion of the mated pair of connectors shown in FIG. 5B.

FIG. 6 illustrates how, when mated, connector housings 21 and 11 fit together such that contacts 15 provide a pressure fit against corresponding connector pads 25. In the mated relationship, a narrow gap 41 is formed between the opposing surfaces of housings 11 and 21. Gap 41 represents the height or thickness of the depressed connector pins 15 when the two housings are mated.

FIG. 6 also shows a cut-away view of an example of the internal wire routing within regions 16 and 23 of housings 11 and 21, respectively. For example, wires 40 connect to individual connector pins 15 of section 16 in connector housing 11. These individual wires are routed to terminals that provide electrical connection to the components on module 10. Likewise, wires 50 provide connection to individual connector pads 25 within fingers 23 of connector housing 21. In like manner, wires 50 are routed to terminals that provide electrical connection to the individual components on main board 20.

In certain applications it may be desirable to provide a means for securely attaching the connector housings to each other, or to the respective boards, to maintain the mating relationship when the boards are subjected to mechanical stress or vibration. This may be achieved through a variety of well known methods and apparatus such as the use of alignment pins, clamps, clips, screw mounts and other well known apparatus.

It should also be understood that although the invention has been described in several embodiments that show channels or slots mated to peninsulas or fingers, it is also appreciated that the three-dimensional areas of pins/pads may be implemented in conjunction with the male/female type of connector of the present invention. By way of example, individual fingers may be disposed along the primary surface of one connector housing, with the mated connector housing having a surface which includes a corresponding plurality of cavities, each of the cavities having a set of contacts oriented to provide electrical connection to individual ones of the corresponding contacts of the fingers.

I claim:

1. Apparatus for connecting a first circuit board to a second circuit board comprising:

a first connector housing for attachment to the first circuit board, the first connector housing having a primary surface formed with a plurality of channels, each channel having a pair of side surfaces and an end surface;

a first set of contacts disposed on the side and end surfaces in a three-dimensional pattern, the first set of contacts providing electrical connection to the first circuit board;

a second connector housing for attachment to the second circuit board, the second connector housing having a primary surface formed with a plurality of fingers for mating to the channels of the first connector housing, each finger having a pair of side surfaces and an end surface;

a second set of contacts disposed on the side and end surfaces of the second connector housing for electrical connection to the second circuit board;

the second set of contacts being arranged in accordance with the three-dimensional pattern such that when the first and second connector housings are placed in a mated relationship by inserting the fingers into the channels, electrical connection between corresponding ones of the first and second set of contacts is established.

2. The apparatus of claim 1 wherein the end surface of each channel is orthogonal to the side surfaces.

3. The apparatus of claim 2 wherein the end surface of each finger is orthogonal to the side surfaces.

4. The apparatus according to claim 3 wherein the primary surfaces of the first and second connector housings have beveled edges.

5. The apparatus of claim 2 wherein the first set of contacts is disposed within one or more of the channels.

6. The apparatus of claim 1 wherein the first set of contacts comprise contact pins, each of the contact pins being electrically coupled to the first circuit board.

7. The apparatus of claim 6 wherein the second set of contacts comprises connector pads, each of the connector pads being electrically coupled to the second circuit board.

8. The apparatus of claim 1 further comprising a gap disposed between the primary surfaces of the first and second connector housings, the gap being formed when the first and second connector housings are in the mated relationship.

9. The apparatus of claim 1 wherein the first and second circuit boards each have a primary, planar surface, with the second connector housing for attachment in a direction normal to the primary, planar surface of the second circuit board such that a stacked orientation between the first and second circuit boards results when the first and second connector housings are in the mated relationship.

10. The apparatus of claim 1 wherein the first and second circuit boards each have a primary, planar surface, with the second connector housing for attachment in a direction generally coplanar to the primary, planar surface of the second circuit board such that a coplanar orientation results between the first and second circuit boards when the first and second connector housings are in the mated relationship.

11. The apparatus of claim 1 further comprising a means for mechanically securing the first and second connector housings in the mated relationship.

12. Apparatus for connecting a first circuit board to a second circuit board comprising:

a first connector housing for attachment to the first circuit board, the first connector housing having a primary surface formed with a plurality of cavities, each cavity having a pair of side surfaces and an end surface;

a first set of contacts disposed on the side and end surfaces in a three-dimensional pattern, the first set of contacts providing electrical connection to the first circuit board;

a second connector housing for attachment to the second circuit board, the second connector housing having a primary surface formed with a plurality of fingers for mating to the channels of the first connector housing, each finger having a pair of side surfaces and an end surface;

a second set of contacts disposed on the side and end surfaces of the second connector housing for electrical connection to the second circuit board;

the second set of contacts being arranged in accordance with the three-dimensional pattern such that when the first and second connector housings are placed in a mated relationship by inserting the fingers into the cavities, electrical connection between corresponding ones of the first and second set of contacts is established.

13. The apparatus of claim 12 wherein the end surface of each cavity is orthogonal to the side surfaces.

14. The apparatus of claim 13 wherein the end surface of each finger is orthogonal to the side surfaces.

15. The apparatus according to claim 14 wherein the primary surfaces of the first and second connector housings have beveled edges.

16. The apparatus of claim 13 wherein the first set of contacts is disposed within one or more of the cavities.

17. The apparatus of claim 12 wherein the first set of contacts comprise contact pins, each of the contact pins being electrically coupled to the first circuit board.

18. The apparatus of claim 17 wherein the second set of contacts comprises connector pads, each of the connector pads being electrically coupled to the second circuit board.

19. The apparatus of claim 12 further comprising a gap disposed between the primary surfaces of the first and second connector housings, the gap being formed when the first and second connector housings are in the mated relationship.

20. The apparatus of claim 12 wherein the first and second circuit boards each have a primary, planar surface, with the second connector housing for attachment in a direction normal to the primary, planar surface of the second circuit board such that a stacked orientation between the first and second circuit boards results when the first and second connector housings are in the mated relationship.

21. The apparatus of claim 12 wherein the first and second circuit boards each have a primary, planar surface, with the second connector housing for attachment in a direction generally coplanar to the primary, planar surface of the second circuit board such that a coplanar orientation results between the first and second circuit boards when the first and second connector housings are in the mated relationship.

22. The apparatus of claim 12 further comprising a means for mechanically securing the first and second connector housings in the mated relationship.

23. A system for connecting first and second circuit boards comprising:

a first connector housing attached to the first circuit board, the first connector housing having a plurality of channels disposed along an edge, each channel having first, second, and third surfaces, with the second surface being orthogonal to both the first and third surfaces;

a first set of contacts disposed on the first, second, and third surfaces of each of the channels in a three-dimensional arrangement, the first set of contacts being electrically connected to the first circuit board;

a second connector housing attached to the second circuit board, the second connector housing having a corresponding plurality of fingers that mate with the channels, each finger having fourth, fifth, and sixth surfaces, with the fifth surface being orthogonal to both the fourth and sixth surfaces;

a second set of contacts disposed on the fourth, fifth, and sixth surfaces of the second connector housing in accordance with the three-dimensional arrangement such that when the first and second connector housings are placed in a mated relationship by inserting the corresponding plurality of fingers into the plurality of channels, electrical connection is established between corresponding ones of the first and second sets of contacts, the second set of contacts being electrically connected to the second circuit board.

24. The system of claim 23 wherein a first subset of the first set of contacts is arranged in two dimensions on each of the first and third surfaces.

25. The system of claim 24 wherein a first subset of the second set of contacts is arranged in two dimensions on each of the fourth and sixth surfaces.

26. The system of claim 25 wherein a second subset of the first set of contacts is arranged in one dimension on the second surface.

27. The system of claim 25 wherein a second subset of the first set of contacts is arranged in one dimension on the second surface.

28. The system of claim 23 wherein the first and second circuit boards each have a primary, planar surface, with the second connector housing being attached in a direction normal to the primary, planar surface of the second circuit board such that a stacked orientation between the first and second circuit boards results when the first and second connector housings are in the mated relationship.

29. The system of claim 23 wherein the first and second circuit boards each have a primary, planar surface, with the second connector housing being attached in a direction generally coplanar to the primary, planar surface of the second circuit board such that a coplanar orientation results between the first and second circuit boards when the first and second connector housings are in the mated relationship.

30. The system of claim 23 wherein the first set of contacts comprise spring loaded contact pins.

* * * * *